United States Patent [19]

Smith

[11] 3,978,623

[45] Sept. 7, 1976

[54] APPARATUS FOR VIBRATORY POLISHING OF STONES AND THE LIKE

[75] Inventor: Edward Earl Smith, New London, Iowa

[73] Assignee: Geode Industries, Inc., New London, Iowa

[22] Filed: Aug. 16, 1974

[21] Appl. No.: 498,070

[52] U.S. Cl. ..... 51/163.1
[51] Int. Cl.[2] ..... B24B 31/06
[58] Field of Search ..... 51/163, 7; 259/72

[56] References Cited

UNITED STATES PATENTS

| | | | |
|---|---|---|---|
| 1,918,018 | 6/1931 | Clark | 259/72 |
| 3,108,408 | 10/1963 | Dahlquist et al. | 51/163 |
| 3,163,966 | 1/1965 | Moore | 51/163 |
| 3,163,967 | 1/1965 | Moore | 51/163 |
| 3,637,190 | 1/1972 | Isaacson | 51/163 UX |
| 3,769,758 | 11/1973 | McDonald | 51/163 |

*Primary Examiner*—Harold D. Whitehead
*Attorney, Agent, or Firm*—Haven E. Simmons; James C. Nemmers

[57] ABSTRACT

A method of polishing material for lapidary and like purposes, the material and abrasive being tumbled in a vibrated container which alternately compacts the material against a wall of the container and then separates it in order to reduce the time required for polishing. Apparatus for carrying out the method vibrates the container of the material and abrasive so that a portion of its orbit is about a theoretical center which is above and to one side of the center of gravity of its mass.

7 Claims, 4 Drawing Figures

FIG 2
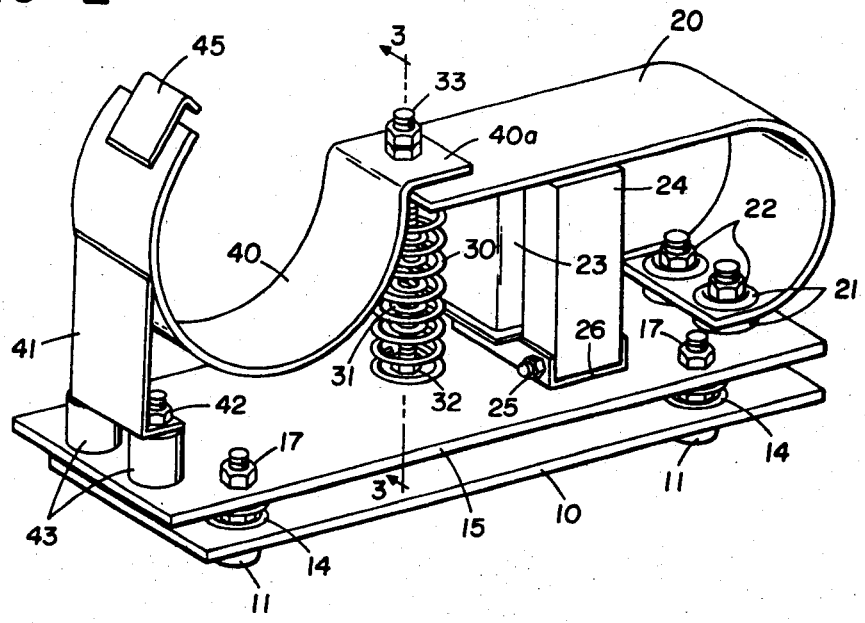
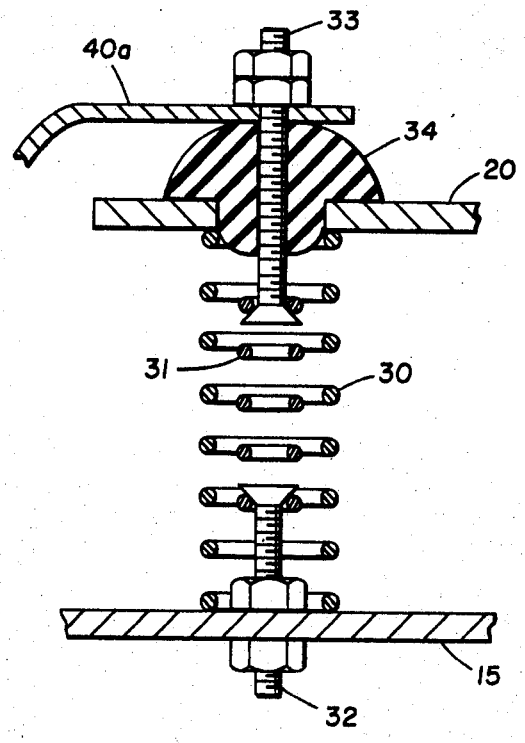
FIG 3

APPARATUS FOR VIBRATORY POLISHING OF STONES AND THE LIKE

BACKGROUND OF THE INVENTION

Tumbling of stones and other objects in a barrel in order to polish them for lapidary purposes is an old and well-known art. That type of tumbling is not only very lengthy, often needing literally weeks, but also tends to remove and polish the high spots only with consequent loss of details and dimensions. Vibratory tumbling, on the other hand, not only requires dramatically less time but allows intricate shapes to be smoothed with little loss of material and dimension. This is probably because the material is being moved very rapidly in very small increments so that the surface of the material is much more evenly treated. In vibratory tumbling, as opposed to barrel tumbling, it is essential where the abrasive is in a liquid medium that at all times there be a thick coating of abrasive on the stones or objects; if the liquid is too thin so that it cannot cling to the material, the two tend to separate, the abrasive sinking to the bottom and the material remaining on top.

At the same time and for the same reason the mass of material and abrasive must also rotate about a "center" in the container and, in order additionally to increase the abrasive action and further reduce the required time, the mass should be "compacted" as it rotates so that the material does not freely separate as is the case in barrel tumbling. "Compacting" in turn usually demands that the container be at least 70–75% full, unlike the case of barrel tumbling, because it is the confining aspect of the walls of the container which provides the compaction as the mass rotates. While vibratory tumbling in the foregoing manner has greatly reduced the time necessary to polish stones and other objects - from four to six weeks in the case of barrel tumbling to seven to ten days in the case of vibratory tumbling using the machine of my prior U.S. Pat. No. 3,197,922 - yet it obviously would be helpful to reduce the latter time still further. That, therefore, is the primary object of the present invention.

SUMMARY OF THE INVENTION

As mentioned, rotation of the material and abrasive is required so that there will not be separation of the two in the container. Heretofore, that rotation has always been about a "center" which is at all times substantially the same as or below the center of gravity of the mass or, in some cases, the "center" of the container itself. This occurs owing to the vibratory action even though the container does not itself have an "orbit", such as when the vibratory action reciprocates the container in substantially lateral or vertical directions only. It has been discovered that if the material, the stones or other objects, can separate somewhat during their "orbit", the polishing action is substantially improved and the time required correspondingly shortened. This may be because separation permits fresh abrasive to get between the individual stones during each orbit. When the center of the orbit is the same as or below the center of gravity of the mass or of the container itself, as in the prior art, very little if any separation occurs. On the other hand, it has been found that if the theoretical center of at least a portion of the material's orbit is above, and preferably laterally disposed from, the center of gravity of the material, much better separation occurs between the stones together with a corresponding increase in compaction against the wall of the container, both of which add to the efficacy and speed of the polishing process.

The apparatus of the invention involves revamping one type of prior art vibratory machine to provide a theoretical center of orbit of the mass of material and abrasive which is above and laterally disposed from the center of gravity of the mass. Many prior art machines, such as that in my aforesaid patent 3,197,922, orbit the container itself to provide rotation of the mass but the center of orbit of the latter is instead at or below the center of gravity of the mass. Other machines, such as that of U.S. Pat. No. 3,769,758, simply reciprocate the container vertically, and though this produces rotation of the mass, its center of rotation is nevertheless below that of its center of gravity. The latter type of machine is modified, in the present invention, to provide a substantial lateral component of movement to the container in addition to the vertical one only provided by the original machine. The manner in which this is done, as is explained more fully later on, produces a controlled movement of the container, which is substantially a cylinder laid on its side, such that the path of the mass of material and abrasive coincides with a portion of an orbit about a theoretical center located high up close to the cylindrical container wall and thus well above and to one side of the center of gravity of the mass. As the mass rotates in the container successive portions are first compacted against the area of the container wall most remote from that theoretical center, where the path of the material most nearly coincides with an orbit thereabout, and then begin to separate as they thence move up and laterally across the container toward the theoretical center of orbit and finally, under the additional influence of gravity, down toward the bottom of the container. The separation of the material that occurs during the latter two stages thus permits fresh abrasive to flow in between the material before the next compaction occurs. In short, the modified apparatus produces continuous cycles of first compaction of the material against the container wall followed by its separation and thus carries out the method of the invention.

Other and further features of the present invention will be apparent from the more detailed description which follows and the drawings.

BRIEF DESCRIPTION OF THE DRAWINGS

FIG. 2 is an isometric view of the apparatus of FIG. 1 but with the housing and container removed.

FIG. 3 is a detail sectional view taken along the line 3-3 of FIG. 2.

DETAILED DESCRIPTION OF THE PREFERRED EMBODIMENT

Figure 1:
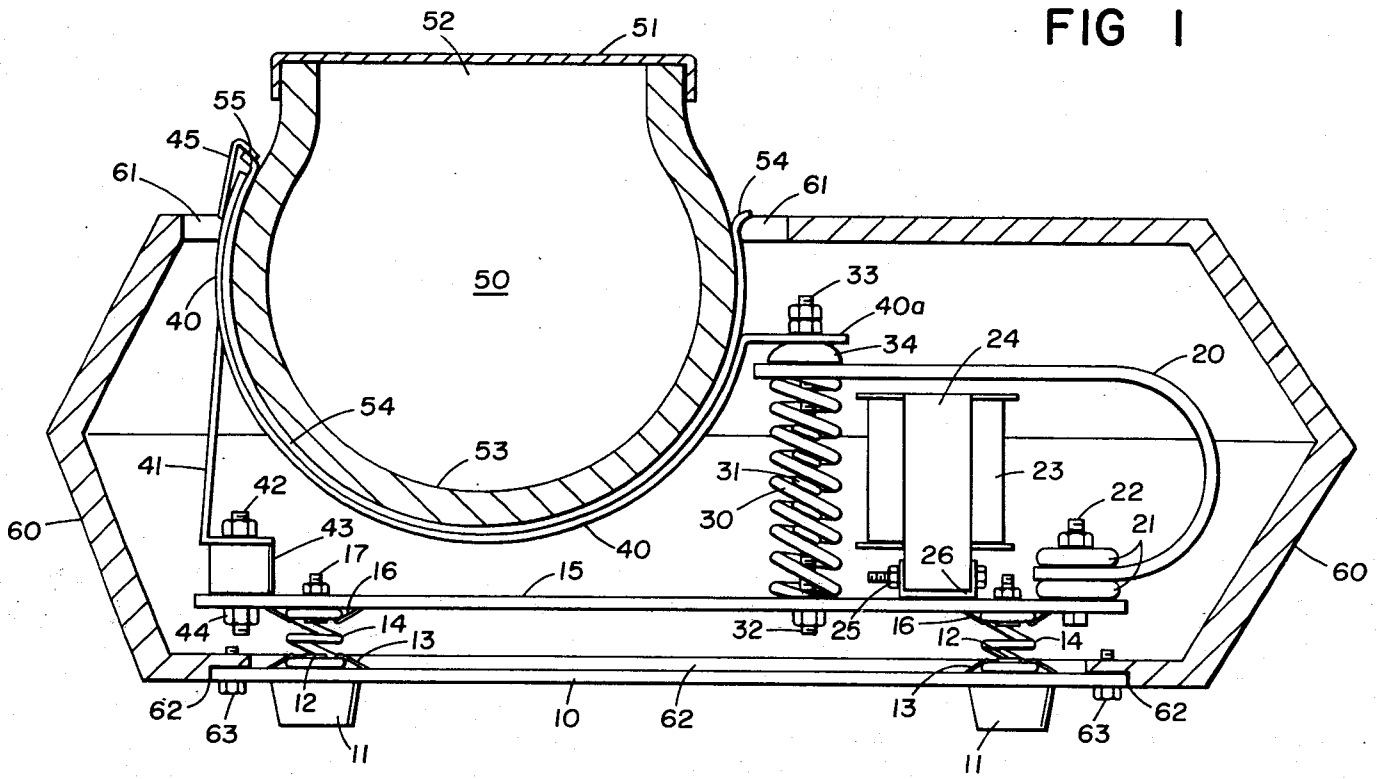
FIG. 1 is a side elevational view of the apparatus of the present invention, its housing and container being shown in section to illustrate the essential arrangement of the apparatus.

The apparatus itself is relatively straight forward in structure and, as shown in FIGS. 1 and 2, includes a base assembly having a lower rectangular base plate 10 supported at its four corners on elastomeric insulators 11 secured by bolts 12. The heads of the latter secure clips 13 to the top face of the base plate 10 which in turn retain the lower ends of upstanding coil springs 14. The upper ends of the springs 14 resiliently and floatingly support an upper rectangular mounting plate 15 to which they are secured in similar manner by clips 16 and bolts 17. Across one end of the base assembly mounting plate 15 is located the lower end of a power bar 20 which is flexibly secured thereto between two pairs of elastomeric buttons 21 by bolts 22. The bar 20, which is of relatively stiff, magnetic material, extends first outwardly over the end of the plate 15 and then curves reversely back over and above the plate 15 parallel thereto, its upper end terminating about half way toward the other end of the plate 15. Beneath the bar 20 is disposed a suitable electromagnetic coil 23 about an upright laminated core 24 bolted at 25 along its lower edge in a U-bracket 26 welded to the mounting plate 15, the upper edge of the core 24 forming a suitable air gap with and beneath the bar 20. The coil 23 is energized from a typical 110 VAC, 60 Hz power source through an on-off switch and a suitable half-wave rectifying diode and rheostat (not shown) of conventional nature. Hence, when energized, the coil 23 during one-half of each cycle pulls the bar 20 downwardly, rocking it about the buttons 21, while during the next half of the cycle, owing to the current rectification, the bar 20 is freed to return to its normal position, the rheostat serving to control the amplitude of its downward movement. The latter movement of the bar 20 is constrained in turn by its compression of a coil spring 30 interposed between the mounting plate 15 and the upper end of the bar 20 while its upward movement is constrained by the tension of a second coil spring 31 within the spring 30. The lower end of the spring 31 is adjustably secured by the head of a bolt 32 to the plate 15 and the upper end by the head of a bolt 33 through an elastomeric grommet 34 seated in an aperture in the upper end of the bar 20 (see FIG. 3). By adjusting the bolt 32, and hence the tension of the spring 31, the upward or "free" movement of the bar 20 can be controlled as well as the initial air gap between it and the core 24.

The bolt 33 also secures the arm 40*a* of a U-shaped container support 40 against the top of the grommet 34. The support 40 extends toward the other end of the plate 15 and is mounted above the latter end by means of an upright L-shaped bracket 41 welded at its upper end to the outer wall of the support 40 and bolted at its lower end at 42 to a pair of elastomeric insulators 43 which in turn are bolted at 44 to the plate 15. The support 40 is carried up beyond the top of the bracket 41 and to its upper end is welded an overhanging container latch 45. The container 50, which is closed by a cover 51, of a molded vinyl and substantially a horizontally disposed cylinder with relatively flat end walls 52, the outer surface of its cylindrical wall 53 being fitted with a protective metal clip 54 which resiliently embraces the container 50 and serves to retain the latter in the support 40, all as shown in FIG. 1. In order to position the container 50 properly, the protective clip 54 is provided with an ear 55 which is engaged by the container latch 45. The entire apparatus is enveloped by a molded housing 60, appropriately apertured at 61 for insertion and removal of the container 50, and provided with an open bottom surrounded by a rabbet 62 within which the base plate 10 fits and to which it is screwed at 63 to secure the housing 60.

Figure 4:
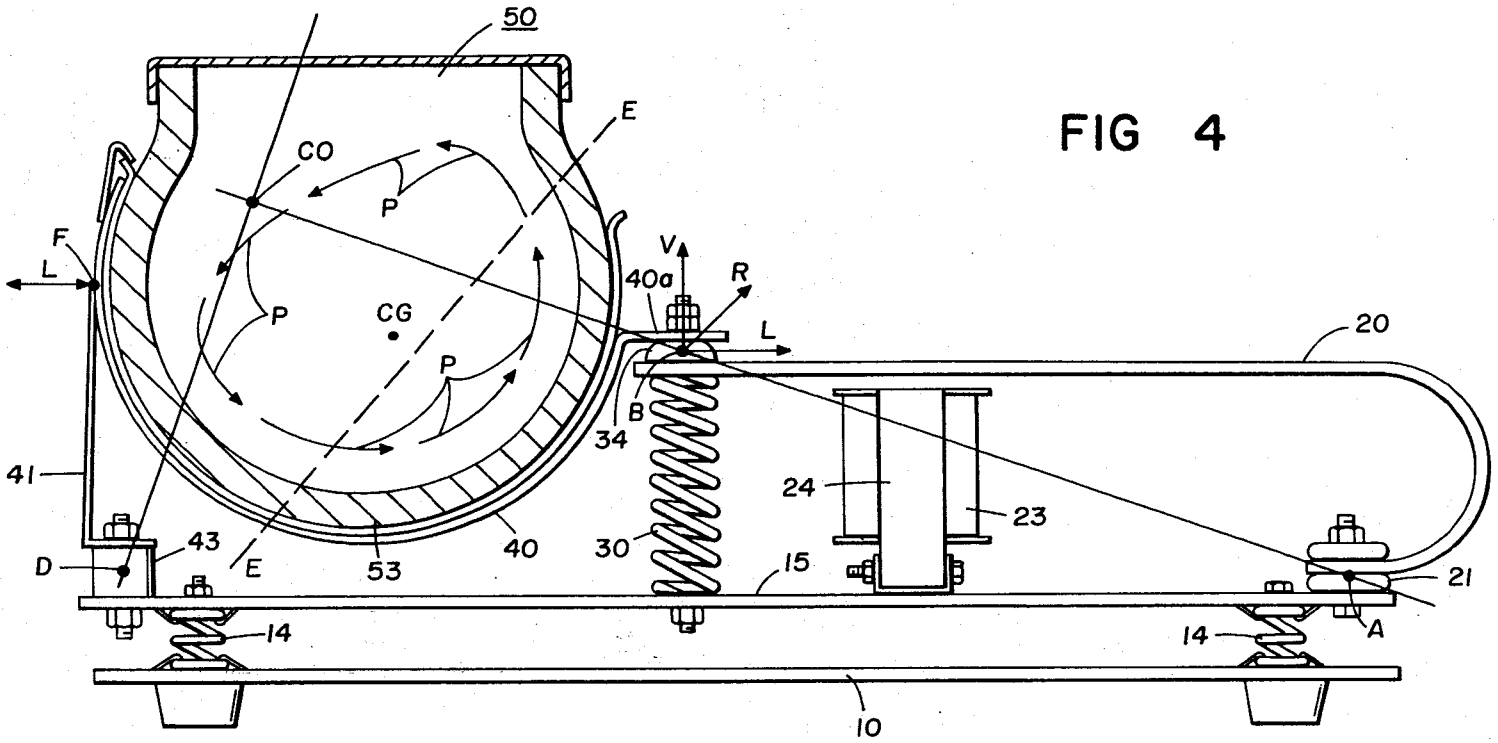
FIG. 4 is a somewhat diagrammatic side elevation illustrating the relationship of the parts and the forces involved by which the method of the invention is carried out by the apparatus.

Turning now to FIG. 4, observe that the action of the coil 23 produces a reciprocal movement of the container support arm 40*a* having vertical components indicated by the arrow V and lateral components indicated by the arrow L, the resultants R of which are of course transmitted to the container 50. This is because, as previously noted, the bar 20 rocks or pivots on the buttons 21 substantially about an axis through point A which is parallel to the horizontal axis of the container 50 and well below another axis parallel thereto through the point B about which, as a result of the grommet 34, the power bar 20 and the container support arm 40*a* pivot relative to each other. The vibratory motion thereby imparted to the container 50 is also enhanced by a certain amount of "feedback" through the mounting plate 15 owing to its resilient support by the springs 14 above the base plate 10. The approximate path followed by the mass of material and abrasive (which can be wet or dry), as it rotates about an axis through its body parallel to the other three axes, is indicated by the arrows P. In the case of the present apparatus, it has been determined that if, as shown, a line through the points A and B is extended, its intersection CO with a line perpendicular thereto through the point D on still another axis parallel to the other four, about which the bracket 41 pivots on its insulators 43, will be closely the theoretical center of a portion of the path of the mass as it rotates in the container 50 when the machine is operating, namely, that portion of the path which is below the broken line E—E. It will be obvious from this that that theoretical center of orbit CO is well above and to one side of the center of gravity CG of the mass by virtue of the fact that the direction of the reciprocating movement R of the support arm 40*a* is inclined between the vertical and the horizontal while the reciprocating movement at the point F at the other end of the container support 40 atop the bracket 41 is substantially horizontal only, as indicated there by the arrow L. Compaction of the material occurs during that portion of its path below the line E—E because there the material is most remote from the theoretical center of orbit CO, most nearly follows a true orbit about the center CO, and is most confined by the cylindrical container wall 53. Above the line E—E the material begins to separate as it moves across the container 50 toward the center CO and finally, under the added force of gravity, back down to begin a new cycle of alternate compaction and separation.

The reduction in polishing time resulting from the method and apparatus is substantial indeed, approximately 20% to 25% less than that of the machine in my aforesaid patent 3,197,922 and approximately 30% to 35% less than that of the machine in the aforesaid patent 3,769,758. While it is preferable that the theoretical center of orbit CO be offset from, as well as above, the center of gravity CG of the mass, that is not absolutely crucial. However, if the center CO is directly above the center of gravity CG, the speed of rotation of the mass is reduced with a consequent reduction in the rapidity of the polishing process and thus loss of efficiency. Correspondingly, the greater the offset of the center CO the faster the rotation of the mass and the quicker the polishing. Nor need the center CO be somewhere in the container 50 itself; it can just as well and with like efficacy lie outside the container's upper confines. In any event, though the apparatus of the present invention has been described in terms of a particular embodiment, being the best mode presently known of carrying out the invention, it is not therefore limited to that embodiment alone. Likewise, the method of the present invention may be practiced by apparatus other than that shown and described. Hence the following claims are to be read as encompassing all adaptations and modifications of the invention falling within its spirit and scope.

I claim:

1. An apparatus for the polishing of material such as stones and the like including a container for the material and abrasive medium, the container having a wall with an inner containing surface arcuate with respect to a first generally horizontal axis, the improvement comprising: first means supporting the container at a first location adjacent said wall laterally disposed in one direction from the first axis, the first supporting means providing for reciprocal movement of the container in a first direction which is substantially horizontal only and transversely of the first axis; second means supporting the container at a second location adjacent said wall laterally disposed in the opposite direction from the first axis, the second supporting means providing for reciprocal movement of the container in a second direction which is substantially inclined between vertical and horizontal directions and generally toward and away from a vertical plane containing the first axis, the first and second supporting means being operatively connected for conjoint movement thereof in said respective first and second directions, said movement of one of the supporting means imparting said movement of the other of the supporting means thereto; and power means providing vibratory movement of one of the supporting means in its said direction, said movements of the first and second supporting means being imparted to the container.

2. The apparatus of claim 1 wherein said operative connection of the first and second supporting means comprises a container holding assembly engaging said container wall, the holding assembly having spaced first and second locations thereon, the first location being connected to the first supporting means and the second location to the power means, the power means and the second location on the container holding assembly comprising the second supporting means.

3. The apparatus of claim 2 wherein the container holding assembly includes an upwardly opening U-shaped container holding member, the container holding member having opposite first and second ends constituting said first and second locations on the container holding assembly, and wherein the first supporting means comprises an upright member connected at a first end to the first end of the container holding member and at a second end for movement about a second axis laterally disposed from and parallel to the first axis, a line through said connections at the upright member first and second ends being substantially parallel to said vertical plane.

4. The apparatus of claim 3 including a base assembly, the second end of the upright member being supported by the base assembly, and wherein the power means includes an elongated power member of rigid magnetic material extending horizontally above the base assembly in spaced relation thereto and transversely of said axes, the power member terminating in first and second ends, the first end being offset from and substantially below the second end and secured to the base assembly for pivoting movement of the power member relative thereto about a third axis parallel to said first and second axes, the second end of the power member being attached to the second end of the container holding member for pivoting movement relative thereto about a fourth axis parallel to and substantially above the level of the third axis, and electromagnetic vibrator means secured to the base assembly adjacent the power member effective to produce vibratory movement of the same about the third axis.

5. The apparatus of claim 4 wherein the base assembly includes a lower base plate horizontally supportable on a surface, an upper mounting plate horizontally spacedly disposed above the base plate and having the upright and power members and the vibrator means secured as aforesaid to the top face thereof, and means disposed between said plates floatingly supporting the mounting plate relative to the base plate.

6. The apparatus of claim 5 including vibration control means interposed between the mounting plate and the second ends of the container holding and power members, the control means including a resiliently compressible member and a resiliently extensible member, the compressible member being disposed in compression between the mounting plate and the second ends of the container holding and power members, the extensible member being adjustably connected in tension to the mounting plate and to the second ends of the container holding and power members.

7. The appartus of claim 6 wherein the compressible and extensible members comprise a pair of outer and inner, respectively, helical springs.

* * * * *